US008485618B2

(12) United States Patent
Benz et al.

(10) Patent No.: US 8,485,618 B2
(45) Date of Patent: Jul. 16, 2013

(54) KITCHEN DEVICE WITH HEIGHT ADJUSTABLE SHELVING SYSTEM

(75) Inventors: Thomas Benz, Neu-Ulm (DE); Michael Krapp, Nattheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 694 days.

(21) Appl. No.: 12/085,075

(22) PCT Filed: Oct. 18, 2006

(86) PCT No.: PCT/EP2006/067550

§ 371 (c)(1),
(2), (4) Date: May 15, 2008

(87) PCT Pub. No.: WO2007/062913

PCT Pub. Date: Jun. 7, 2007

(65) Prior Publication Data

US 2009/0261704 A1 Oct. 22, 2009

(30) Foreign Application Priority Data

Nov. 30, 2005 (DE) ..... 10 2005 057 148

(51) Int. Cl.
*A47B 96/02* (2006.01)

(52) U.S. Cl.
USPC ..... 312/408; 312/312

(58) Field of Classification Search
USPC ..... 312/401, 408, 410, 294, 306, 312, 312/319.5, 319.7, 351; 108/106, 107, 108, 108/147, 147.11, 147.17; 62/440, 382
See application file for complete search history.

(56) References Cited

U.S. PATENT DOCUMENTS

| | | | | |
|---|---|---|---|---|
| 1,920,825 | A * | 8/1933 | Williams | 211/1.57 |
| 3,063,775 | A | 11/1962 | Snowman | |
| 3,337,283 | A * | 8/1967 | Schlenkert | 312/306 |
| 3,361,510 | A * | 1/1968 | McDermott | 312/312 |
| 3,982,801 | A | 9/1976 | Heidorn et al. | |
| 4,151,804 | A * | 5/1979 | Wache et al. | 108/147 |
| 4,566,741 | A * | 1/1986 | Eriksson et al. | 312/194 |
| 5,199,778 | A | 4/1993 | Aoki et al. | |
| 5,913,584 | A * | 6/1999 | Swindell et al. | 312/408 |
| 6,065,821 | A * | 5/2000 | Anderson et al. | 312/408 |

(Continued)

FOREIGN PATENT DOCUMENTS

| | | |
|---|---|---|
| EP | 1 692 967 | 8/2006 |
| JP | 4-122307 | 4/1992 |
| WO | WO 2007/031407 | 3/2007 |

OTHER PUBLICATIONS

International Search Report PCT/EP2006/067550.

*Primary Examiner* — James O Hansen
(74) *Attorney, Agent, or Firm* — James E. Howard; Andre Pallapies

(57) ABSTRACT

A kitchen device, in particular, a refrigerator or freezer, with an interior, in which at least one height-adjustable support for accommodation of goods is provided, wherein at least one transport carriage running along guide rails is provided on the kitchen device, wherein said transport carriage may be fixed to the support and adjusted in height by a drive with a height adjustment. The invention is characterized in that the shell surface may be particularly simply and easily adjusted for height without the need to remove the goods from the kitchen device operation of the kitchen device being particularly simple.

13 Claims, 4 Drawing Sheets

Figure 1:
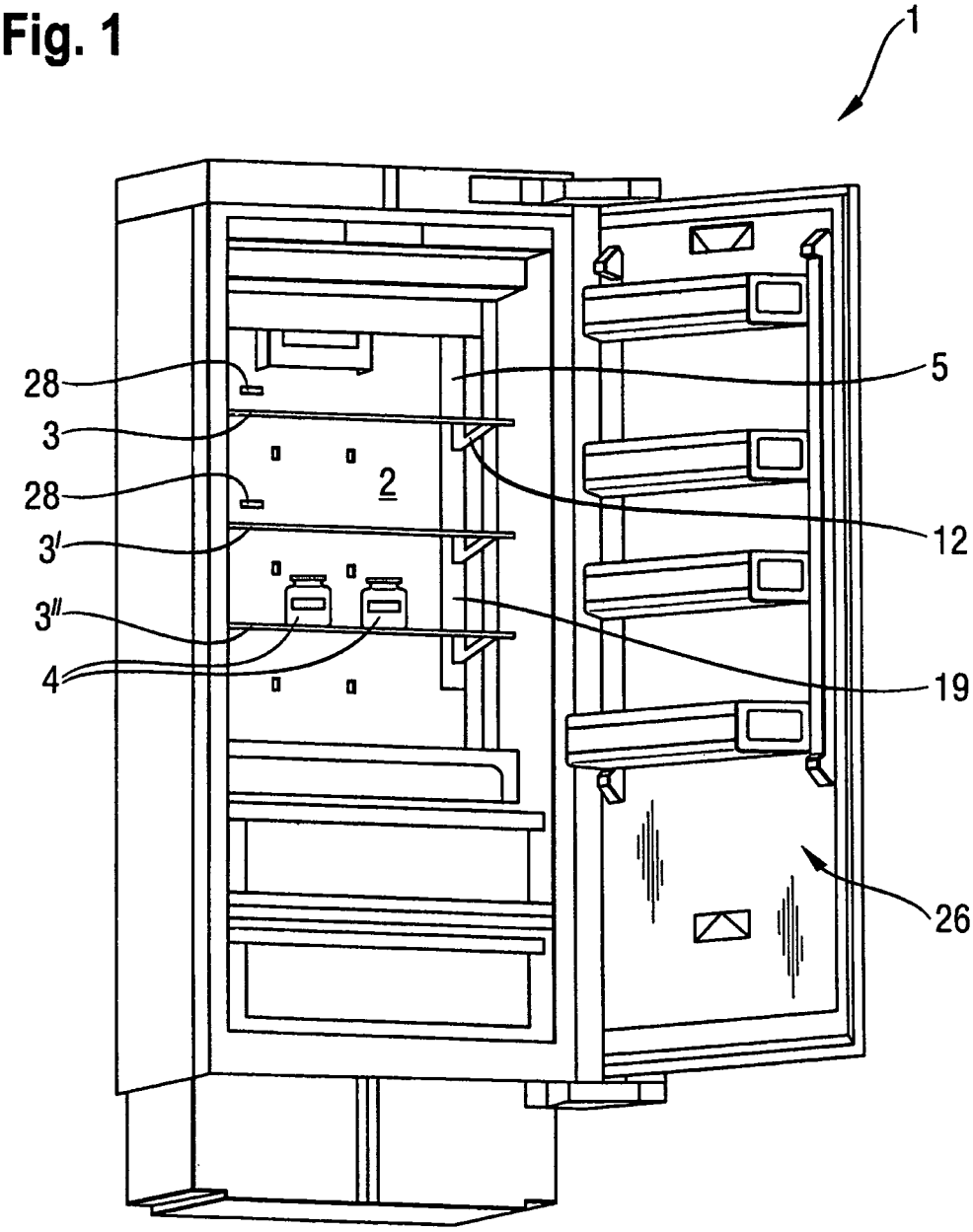

U.S. PATENT DOCUMENTS 6,361,131 B1 * 3/2002 Powell, Jr. ..... 312/312
6,363,738 B2 * 4/2002 Nakajima et al. ..... 62/440
7,178,890 B2 * 2/2007 Park et al. ..... 312/408
2004/0263037 A1 * 12/2004 Ritchie et al. ..... 312/405.1

* cited by examiner

KITCHEN DEVICE WITH HEIGHT ADJUSTABLE SHELVING SYSTEM

The invention relates to a kitchen device, in particular a refrigerator or freezer, with an interior in which at least one height-adjustable support for accommodation of goods is provided.

Equipping refrigeration devices, especially refrigerators or freezers, with height-adjustable compartments or height-adjustable shelf surfaces is known, so that an interior of the refrigeration device can be well utilized in accordance with requirements. To this end a plurality of supporting bars are generally provided arranged at different heights in the interior of the refrigeration device, into which the shelf surfaces or compartments can be inserted. If the height of the shelves or compartments is to be adjusted, it is necessary to take out the goods stored on the shelves or in the compartments of the refrigeration device.

The object of the present invention is to specify a kitchen device, especially a refrigerator or freezer, which allows an especially good storage of goods which exploits the available space as well as possible and simultaneously provides flexibility in an interior space of the kitchen device.

In accordance with the invention this object is achieved as specified in the independent claims. Further advantageous embodiments and developments, able to be employed individually in each case or to be suitably combined in any way with each other are the subject matter of the dependent claims.

The inventive kitchen device, especially refrigeration or freezer device, with an interior in which at least one height-adjustable support for accommodation of goods is provided, makes provision for at least one guide rail and at least one transport carriage guided along the guide rail to be provided, with the transport carriage able to be connected to the support and to have its height adjusted by a drive with a height adjustment.

The kitchen device is preferably a refrigerator or freezer or a combined fridge/freezer. It can however also be another kitchen device such as a dishwasher, a cooker or an oven for example. The support can be a shelf surface, a storage compartment, a wire grid, a metal plate or a crockery basket. Goods include food, cooled goods, pastries, dishes and ovenware. Hydraulics can be used as a drive; however an electric motor is preferred.

The support can especially be continuously adjusted between a lower first height and a higher second height.

The height adjustment enables the support and thereby the goods located on the support to be adjusted so that an efficient utilization of space is made possible in the interior. The interior can be reconfigured in a simple manner and adopted in the optimum way to goods of different sizes.

In addition the height-adjustment makes it easier to take out goods from the interior in that the support with the goods can be moved to a convenient height for the user of the kitchen device.

The interior of the kitchen device has a volume ranging from 50 I-1000 I, especially ranging from 100 I to 300 I.

A support is especially held by two transport carriages, a first transport carriage on a left side of the interior and a second transport carriage on a right side of the interior.

The support is moved with the aid of the at least one transport carriage. The transport carriages are guided along a guide rail. Advantageously the support can be released from the transport carriage. The support can especially be latched into, onto or suspended from the transport carriage. This is for example advantageous for cleaning purposes.

Advantageously the guide rail has a rotatably supported threaded rod and the transport carriage engages with the threaded rod. A thread is provided on the transport carriage for this purpose. The threaded rod is rotated with the aid of the drive, which enables the height of the transport carriage to be adjusted.

Expediently at least two guide rails are especially provided and the height-adjustment features at least two threaded spindles which are connected to each other via a coupling shaft in a connection which transmits the rotation. With the aid of the guide rail and threaded spindles a synchronized movement of the transport carriage is possible.

The synchronized movement avoids tilting of the support in the interior and guarantees safe and quiet operation during the height adjustment. To this end the guide rails are distributed as far as possible from each other along the support, so that even support is provided. A rotation of a first threaded spindle is synchronized by the coupling shaft with the rotation of a second threaded spindle. The use of the spindles also has the advantage that a height adjustment of the support under the load of the goods when the drive is switched off is prevented by a self-locking system. An additional latching of the transport carriage in the guide rails is then no longer required.

The drive especially enables a quiet height adjustment of the support downwards and upwards.

Advantageously the coupling shaft is connected to at least one of the two threaded spindles via a worm gear set. The worm gear set allows an especially compact construction of the height adjustment and in addition offers the functionality of a reduction gear, so that drives with comparatively high rotational frequencies can be used.

The use of higher-frequency drives allows the use of smaller, space-saving, low-cost and energy-saving drives.

The transmission ratio of the worm gear set amounts to at least 5:1, especially at least 10:1, preferably 15:1.

In another embodiment the coupling shaft is connected to at least one of the two threaded spindles via a pair of beveled gears, a hypoid gear pair or a crossed helical gear pair. The transmission ratio in this case can be especially at least 2:1, especially at least 3:1, preferably at least 5:1.

In an especially advantageous embodiment of the invention the connection transmitting the rotation has at least one elastic first coupling. With the aid of the elastic first coupling length tolerances, manufacturing tolerances and axle offsets can be compensated for which guarantees a high level of quiet operation. A rotationally-elastic plastic element, a slotted sleeve or a torsion spring can be used as the first elastic coupling for example.

The guide rail can also feature a torsion element, especially an advantageously profiled bar, a cable or a chain, with which the height of the transport carriage can be adjusted along the guide rail. The power is transmitted to the support in this case by the torsion element. To avoid the support slipping, the torsion element has a profile, especially teeth, or chain links.

Advantageously the support is able to be attached to the transport carriage to enable subsequent detachment. The support can for example be hooked in, suspended, plugged in or clipped on, with it advantageously being possible to replace or exchange it.

In a specific embodiment of the invention a further support can be attached to the guide rail. The further support can be guided height-adjustably in the guide rail or fixed height-adjustably. For example the further support can be latched-in at predetermined heights in steps. The further support is especially not height-adjustable by the drive. The guide rail then has a duplicate function; on the one hand it accepts the further support at fixed predetermined positions, on the other a height-adjustable support can slide along it.

Advantageously the guide rail has a protective cover. The protective cover prevents contaminants, especially food residue or liquid, getting into the guide rail, which could otherwise adversely affect the functioning of the height adjustment. The protective cover can consist of a cover panel, a movable cover sheet or a moveable cover plate, an elastic louvered seal or other seals or can feature said items. The protective cover can feature a labyrinth seal. Advantageously, at its lower end, the guide rail has an opening from which liquid contaminants can flow out of the guide rail.

Advantageously the drive is connected via a second elastic coupling to the height adjustment to transmit the rotation. The quiet operation is increased by the second elastic coupling. An abrupt startup or hesitation of the support can be effectively prevented in this way. For example the second elastic coupling features a belt transmission with a belt and two pulleys. The belt can be made of a rubber-like material.

The transmission ratio of the belt transmission amounts especially to at least 1.5:1, especially at least 2:1, preferably at least 4:1. This transmission ratio further reduces the rotary frequency of the drive, with in a corresponding manner higher-frequency motors being able to be used which can be designed to be more compact, more energy-saving and lower-cost.

The support is especially supported by two transport carriages.

Advantageously at least one stop sensor is provided on the guide rail. As soon as the stop sensor detects that the transport carriage has arrived at its highest or lowest intended setting, the drive is designed to avoid the transport carriage hitting a stop. With the aid of the stop sensor a safe operation of the height adjustment can be guaranteed.

Advantageously a safety sensor is provided which monitors the interior of the device and with which a collision of objects in the interior of the device can be prevented. Advantageously the safety sensor is provided on a transport carriage or on the mobile support and moves along with the latter. The safety sensor can in this case be embodied as a movement sensor which switches off the drive as soon as an object gets too close to the support from below. A second safety sensor can be provided in the upper area of the device, through which goods located on the support can be prevented from hitting a roof of the device.

Further details and advantageous embodiments, which can each be used individually or combined in a suitable manner in any way with each other, are explained in greater detail with reference to the following drawing, which are not intended to restrict the invention but are merely designed as typical illustrations.

Figure 2:
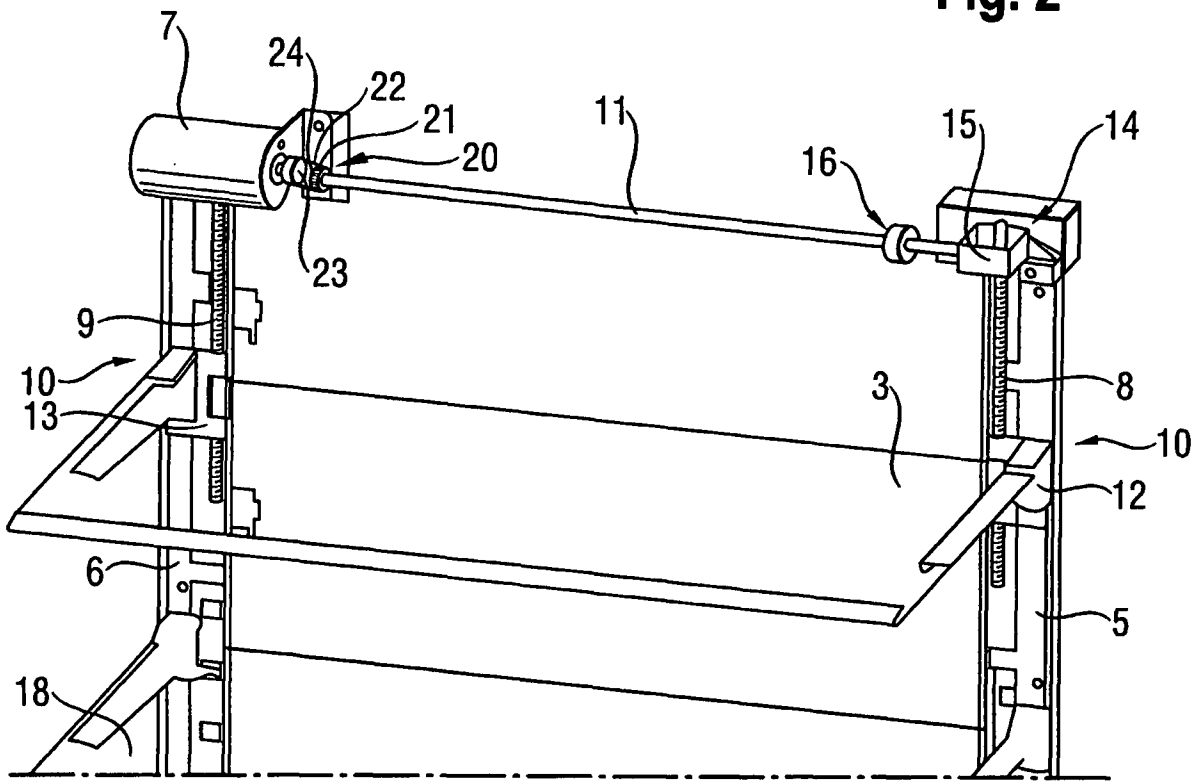
Figure 3:
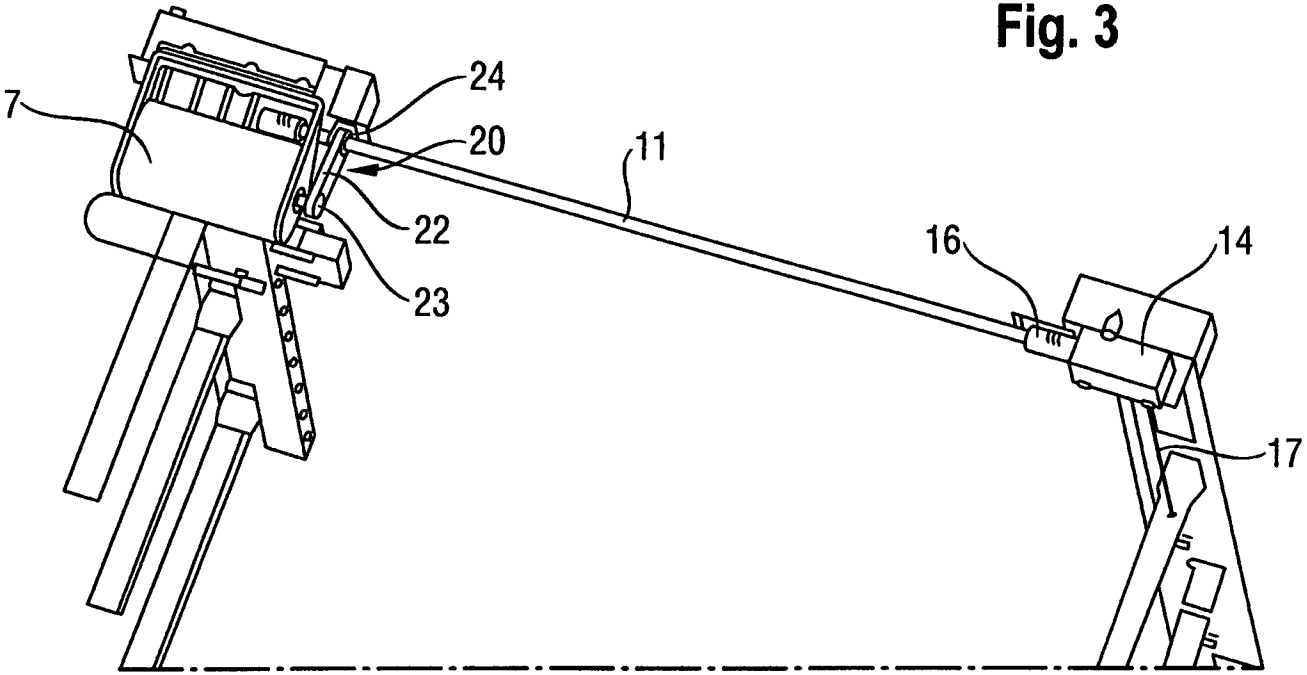
Figure 5:
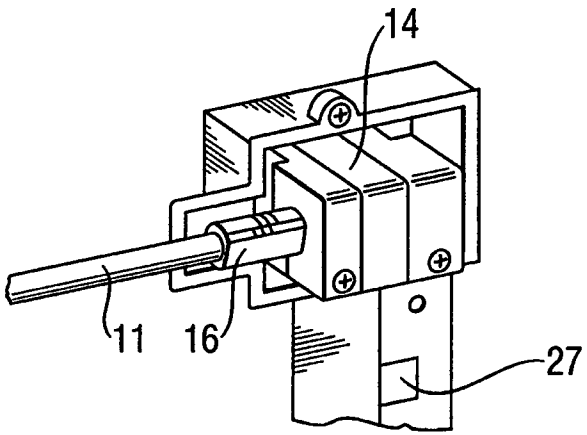
Figure 4:
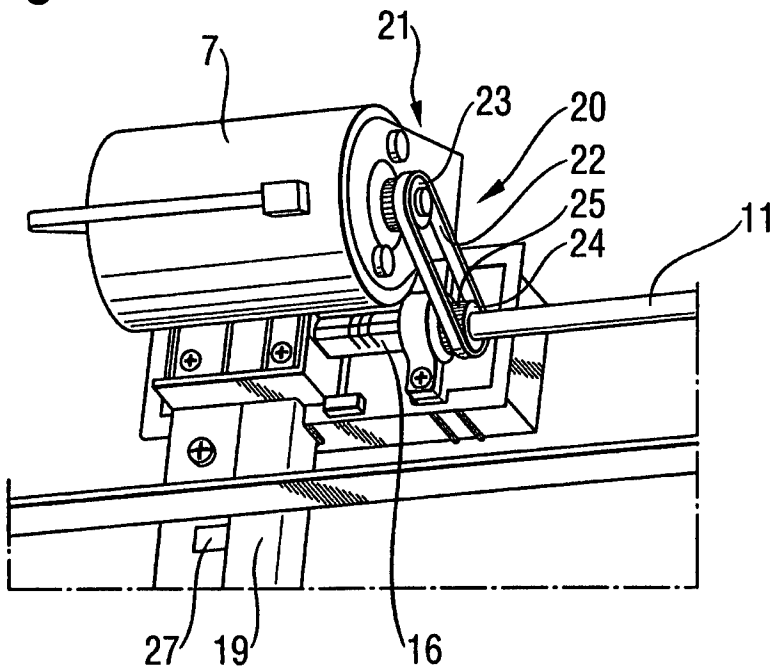

The figures show the following schematic diagrams:

FIG. 1 an inventive kitchen device in a perspective angled view;

FIG. 2 a detailed view of the kitchen device shown in FIG. 1, which shows the height adjustment;

FIG. 3 a further detailed view of a further inventive kitchen device which shows the height adjustment;

FIG. 4 and FIG. 5 further detailed views of an inventive kitchen device which show details of a height adjustment.

FIG. 1 shows an inventive kitchen device 1 with an interior 2, in which there are three supports 3, 3', 3" arranged at different heights. There are goods 4 on support 3'. The uppermost support 3 is height-adjustable. The two lower supports 3' and 3" can be locked at different heights but are however not continuously adjustable or able to be moved to different heights by a drive.

The topmost support 3 is able to be moved or driven by a drive 7. The current height of the topmost support 3 is monitored with the aid of safety sensors 28. The support 3 is moved along a first guide rail 5 with the aid of a first transport carriage 12. The first guide rail 5 is protected by a protective cover 19. The kitchen device 1 is embodied as a refrigerator and features a door 26.

FIG. 2 shows a section from an inventive kitchen device 1 and shows how the height adjustment functions. A drive 7 is provided for this purpose which transmits a rotary movement to a coupling bar 11 via a belt transmission 21 with a belt 22 and a first 23 and a second 24 pulley. The coupling bar 11 drives a worm drive gear set 15 via an elastic first coupling 16, which establishes a rotation-transmitting connection 14 to a first threaded spindle 8. In a corresponding manner a rotation-transmitting connection 14 is established between the coupling shaft 11 and a second threaded spindle 9, so that a first 12 and a second 13 transport carriage can be moved along the first 5 and a second 6 guide rail. A rigid coupling between the drive 7 and the coupling shaft 11 is avoided by the belt transmission 21, so that a soft startup or stopping of the movement of the transport carriage 12, 13 is produced. Manufacturing tolerances and other inaccuracies between the two transport carriages are compensated for by the elastic first coupling 16. This achieves especially quiet operation during the height adjustment. A further support 18 is suspended in a fixed position in the guide rails 5, 6. The first 12 and second 13 transport carriage carry a support 3 for accommodating goods 4.

FIG. 3, like FIGS. 4 and 5, shows a further section from the kitchen device 1, with the figure depicting the transmission of torque of the drive 7 to the transport carriages 12, 13. The belt transmission 21 represents an elastic second coupling 20 which ensures quieter operation. The transmission ratio between the first 23 and second 24 pulleys amounts to 2:1, which reduces the rotational frequency of the drive 7. Likewise in the rotation-transmitting connection 14 the rotation frequency is reduced by a factor of 5, so that electric motors with comparatively high rotational frequencies can be used as the drive 7. This makes it possible to move comparatively heavy masses on the support 3 with electric motors having small dimensions. FIG. 3 shows a torsion element 17 which is embodied as a cable, with which the height of the first transport carriage 12 can be adjusted.

A stop sensor 27 can be seen in FIGS. 4 and 5, which detects the position of the first 12 or second 13 transport carriage and stops the drive 7 as soon as the transport carriages 13 are approaching their end positions. With the aid of the height adjustment the interior 2 can be divided up variably and a user-friendly operation of the interior 2 is made possible.

The invention relates to a kitchen device 1, especially a refrigerator or a freezer, with an interior 2, in which at least one height-adjustable support 3 for accommodation of goods 4 is provided, with at least one guide rail 5, 6 and at least one transport carriage 12, 13 guided along the guide rail 6 being provided on the kitchen device 1, with the transport carriage 13 being connected to the support 3 and its height being able to be adjusted by a drive 7 with a height adjustment 10. The characterizing feature of the invention is that the height of shelf surfaces can be adjusted especially simply and conveniently, without the goods having to be taken out of the kitchen device 1, which renders use of the kitchen device 1 especially simple.

LIST OF REFERENCE SYMBOLS

1 Kitchen device
2 Interior

3, 3' Support
4 Goods
5 First guide rail
6 Second guide rail
7 Drive
8 First threaded spindle
9 Second threaded spindle
10 Height adjustment
11 Coupling shaft
12 First transport carriage
13 Second transport carriage
14 Rotation-transmitting connection
15 Worm gear set
16 First coupling
17 Torsion element
18 Further support
19 Protective cover
20 Second elastic coupling
21 Belt transmission
22 Belt
23 First pulley
24 Second pulley
25 Toothing
26 Door
27 Stop sensor
28 Safety sensor

The invention claimed is:

1. A kitchen device including at least one of a refrigerator and a freezer, having an interior compartment containing at least one height-adjustable support for accommodation of goods, the kitchen device comprising:

at least two guide rails;

a drive having a height adjustment assembly; and at least one transport carriage guided along one or more of the at least two guide rails with the transport carriage configured for connection to the support and wherein the transport carriage is configured for height adjustment by the drive, wherein each of the at least two guide rails includes a rotatably-supported threaded spindle and the transport carriage is operatively engaged with the rotatably-supported threaded spindles included on each of the at least two guide rails, the drive includes the rotatably-supported threaded spindles connected to each other using a coupling shaft and a rotation-transmitting connection, the coupling shaft is connected to at least one of the two threaded spindles using a worm gear set, and the coupling shaft includes a first portion connected to a first one of the rotatably-supported threaded spindles, a second portion connected to a second one of the rotatably-supported threaded spindles, and a first elastic coupling connecting the first portion to the second portion.

2. The kitchen device according to claim 1 wherein the one or more guide rails includes a torsion element, including at least one of a profiled belt, a cable and a chain, wherein the height of the transport carriage can be adjusted along the one or more guide rails.

3. The kitchen device according to claim 1 wherein the support is configured for detachable attachment to the at least one transport carriage.

4. The kitchen device according to claim 1 wherein the one or more guide rails is configured for attachment of an additional support member thereto.

5. The kitchen device according to claim 1 wherein the one or more guide rails includes a protective cover.

6. The kitchen device according to claim 1 wherein the drive is connected to the height adjustment assembly using a second elastic coupling to transmit the rotation.

7. The kitchen device according to claim 6 wherein the second elastic coupling includes a belt transmission with a belt and two pulleys.

8. The kitchen device according to claim 7 wherein the transmission ratio of the belt transmission is at least about 1.5:1.

9. The kitchen device according to claim 7 wherein the transmission ratio of the belt transmission is at least about 2:1.

10. The kitchen device according to claim 7 wherein the transmission ratio of the belt transmission is at least about 4:1.

11. The kitchen device according to claim 1 wherein the support is carried by two transport carriages.

12. The kitchen device according to claim 1 and further comprising at least one stop sensor operatively disposed on the one or more guide rails.

13. The kitchen device according to claim 1 and further comprising a safety sensor.

* * * * *